US006669174B1

(12) United States Patent
Vita

(10) Patent No.: US 6,669,174 B1
(45) Date of Patent: Dec. 30, 2003

(54) KNEELESS KICKING TOOL FOR STRETCHING A CARPET

(76) Inventor: Christopher L. Vita, P.O. Box 659, Aquebogue, NY (US) 11931

( * ) Notice: Subject to any disclaimer, the term of this patent is extended or adjusted under 35 U.S.C. 154(b) by 0 days.

(21) Appl. No.: 10/293,113

(22) Filed: Nov. 12, 2002

(51) Int. Cl.[7] ..... B25B 25/00; B65H 77/00
(52) U.S. Cl. ..... 254/212; 294/8.6
(58) Field of Search ..... 254/201, 202, 254/200, 204, 205, 206, 207, 209, 212; 294/8.6

(56) References Cited

U.S. PATENT DOCUMENTS

| | | | | | |
|---|---|---|---|---|---|
| 10,143 | A | * | 10/1853 | Weatherby | 254/205 |
| 268,067 | A | * | 11/1882 | Williams et al. | 254/209 |
| 363,013 | A | * | 5/1887 | Spackman | 254/206 |
| 670,947 | A | * | 4/1901 | Briggs | 254/205 |
| 761,127 | A | * | 5/1904 | Andres | 254/206 |
| 3,441,252 | A | | 4/1969 | Koppelmans | |
| 3,556,479 | A | * | 1/1971 | Palachuk | 254/200 |
| 3,572,800 | A | | 3/1971 | Graziano | |
| 3,706,440 | A | | 12/1972 | Ross | |
| 3,951,382 | A | | 4/1976 | Asbury | |
| 4,003,549 | A | * | 1/1977 | Sergerie | 254/212 |
| 4,084,787 | A | * | 4/1978 | Kowalczyk | 254/201 |
| 4,230,302 | A | | 10/1980 | Crain, Jr. | |
| 5,150,884 | A | | 9/1992 | Hyer et al. | |
| 5,190,328 | A | | 3/1993 | Anderson | |
| 5,228,660 | A | * | 7/1993 | Massicotte | 254/201 |
| 5,288,057 | A | * | 2/1994 | Listau | 254/212 |
| 5,364,143 | A | | 11/1994 | Grady | |
| 5,626,329 | A | * | 5/1997 | Herdan | 254/200 |
| 5,681,031 | A | | 10/1997 | Foley | |
| 5,782,458 | A | * | 7/1998 | Prinzi et al. | 254/209 |
| 5,855,361 | A | * | 1/1999 | Krowchak | 254/209 |
| 5,938,182 | A | | 8/1999 | Goodrich et al. | |

* cited by examiner

*Primary Examiner*—Emmanuel M. Marcelo
(74) *Attorney, Agent, or Firm*—Richard L. Miller

(57) ABSTRACT

A kneeless kicking tool for stretching a carpet. A base rests on the carpet. A head is attached to the base and engages and stretches the carpet when an apparatus for propelling the head is activated. The apparatus includes a pair of rods that extend across the base and a ram. The ram has a body that slides on the pair of rods. When the ram is slid forwardly on the pair of rods and impacts upon the base, the head is caused to move forward and stretch the carpet. The ram further has a handle that extends from the body thereof and is grabbed by the hand of a user and used to slide the ram forwardly, and a weight that extends upwardly from the body thereof and which increases the impact of the ram on the base when the ram is slid forwardly on the pair of rods.

11 Claims, 1 Drawing Sheet

KNEELESS KICKING TOOL FOR STRETCHING A CARPET

BACKGROUND OF THE INVENTION

1. Field of the Invention

The present invention relates to a kicking tool for stretching a carpet. More particularly, the present invention relates to a kneeless kicking tool for stretching a carpet.

2. Description of the Prior Art

Numerous innovations for carpet stretching tools have been provided in the prior art that will be described. Even though these innovations may be suitable for the specific individual purposes to which they address, however, they differ from the present invention.

A FIRST EXAMPLE, U.S. Pat. No. 3,441,252 to Koppelmans teaches a carpet stretcher of the kicker type or of the power stretcher type, having a head with carpet engaging short pins and long pins. The long pins are, for use with normal or with heavy carpets, arranged in two different lengths on either side of a flat grate-shaped frame, which is reversibly connected to the head. A power type stretcher, having as usually a plurality of telescoping tubes between the head and the wall abutting ace at the opposite end, is provided with a series of teeth against which a pawl, hanging below a lever on the head, is placed for stretching and straining the carpet in successive steps by extension of the head, without having to take the pinned head off the carpet.

A SECOND EXAMPLE, U.S. Pat. No. 3,572,800 to Graziano teaches a shock absorbing carpet kicker comprising a cylindrical housing, a head for engaging a carpet affixed to said housing, means within said housing for absorbing shock, an adjustable shaft connected to said means within said housing for absorbing shock, and, a protective pad affixed to said shaft for absorbing the initial shock which is transmitted to said shock absorbing means within said housing.

A THIRD EXAMPLE, U.S. Pat. No. 3,706,440 to Ross teaches a carpet stretching tool with a tail block constructed to permit abutment against the intersection of two projecting vertical wall surfaces, as well as abutment against flat wall surfaces. The improved tail block of the carpet stretching tool is adapted to engage two vertically extending surfaces angularly disposed adjacent each other, as well as a single vertical surface.

A FOURTH EXAMPLE, U.S. Pat. No. 3,951,382 to Asbury teaches an automatic carpet kicker having a spring-propelled carpet-engaging head that is retractable by a foot-operated mechanical linkage.

A FIFTH EXAMPLE, U.S. Pat. No. 4,230,302 to Crain, Jr. teaches a carpet stretcher comprising a pin head. Extending from the pin head in a rearward direction is a sliding bar having a square cross-sectional area. Tubular telescoping extension members freely receive the sliding bar which extends in the axial direction thereof. At the free end of the tubular members is pivotally mounted a wall engaging member. At the opposite end of the tubular members is pivotally mounted a locking lever. A handle is pivotally mounted on the pin head and extends toward the tubular members. Intermediate the ends of the handle is linkage that pivotally connects the handle to the tubular members. Initially, the handle is depressed to apply an axial stretching force to a portion of a carpet. Stretched carpeting produces an axial reactive force within the carpet stretch. After the portion of the carpet is stretched to the desired extent, the operator actuates the locking, which engages the sliding bar through a pivotal movement to retain the sliding bar in the extended position relative to the tubular members against the axial reactive force resulting from the stretched portion of the carpet. Subsequently, the operator again depresses the handle to release the axial reactive force and to enable the locking lever to assume a position for the sliding bar to move freely relative thereto.

A SIXTH EXAMPLE, U.S. Pat. No. 5,150,884 to Hyer, Jr. teaches a portable carpet stretching device enabling a user to stretch carpeting at an angle into engagement with a tack strip affixed along the base of an adjacent wall, thus to eliminate wrinkles. This device comprises a carpet-engaging head member and a relatively fixed base member. The front of the base member is attached by an extensible member to the rear of the head member, and pivotally connected anchoring means are utilized for securing the base member in a desired relationship to the adjacent wall. Power applying means enable the user to force the head member and the base member apart, so the anchoring of the base member with respect to the adjacent wall by the anchoring means results at the time of application of the power means, in the portion of the carpet engaged by the head member being forced toward the adjacent wall and into contact with the tack strip. The anchoring means forming the principal subject matter of this invention comprises a pulling plate having a lower edge adapted to engage the tack strip. The upper edge of the pulling plate is pivotally connected to the base member, with this pivotal connection enabling the head member as well as the frame of the device to be moved into a non-symmetrical relationship to the pulling plate, whereby a pull at an angle to the adjacent wall and the tack strip can be applied to the carpet when the power applying means is operated.

A SEVENTH EXAMPLE, U.S. Pat. No. 5,190,328 to Anderson teaches an improved carpet stretching tool of the knee-kicker type in which outer and inner overlapping, slidably adjustable shank members connect and space a carpet gripping head having a spike plate and a plurality of cotton head sections and a knee plate. A locking system is provided in which the relative positions of the shank members can be adjustably fixed thereby fixing the height of the tool. The locking system employs several teeth integral with the outer shank member and adapted to mesh against mating protuberances integral with the inner shank member and a resilient member to urge the teeth against the protuberances. The teeth have a small amount of negative rake pitch matched by the protuberances to produce a positive wedging of matching inclined planes. The tool also has an improved and simplified carpet gripping cotton head system which employs an unique cotton head assembly and spike plate control system.

AN EIGHTH EXAMPLE, U.S. Pat. No. 5,364,143 to Grady teaches a hand-operated carpet stretcher that has a first handle securely attached to an otherwise convention gripping head engagable with a carpet, and a second handle securely attached to a drive member or mass. The gripping head and drive member are interconnected by a telescoping shank supported on a skid. The shank has an outer, elongated tube connected to the gripping head, and an inner shaft connected to the drive member and terminating in a hammer that is slidingly received within the outer tube. During operation, a carpet installer holds the drive and head handles, and thrusts the drive member in a forward direction towards the gripping head while the tubes telescope together. After a period of free travel during which the drive member develops momentum, the hammer strikes an abutment or anvil provided within the outer tube adjacent to the gripping head. The sudden impact of the hammer on the anvil causes the gripping head to move in the forward direction, thereby stretching the carpet.

A NINTH EXAMPLE, U.S. Pat. No. 5,681,031 to Foley teaches a carpet stretcher foot comprising a base plate and a carpet stretcher receptacle pivotally connected to the base plate. The base plate has a plurality of nail holes adjacent its periphery. The carpet stretcher receptacle is rotatable about the base plate a full 360 degrees whereby the base plate may be secured to a floor with a carpet therebetween and the receptacle may be rotated relative to the floor and the base plate a full 360 degrees in stretching the carpet. There is also provided a method for stretching carpet comprising removably securing a carpet stretcher foot to a floor with a carpet to be stretched therebetween, the foot having a base plate and a carpet stretcher receptacle pivotally secured to the base plate, the receptacle being rotatable about the base plate a full 360 degrees, the carpet stretcher having a stretcher head and an expandable tube positioned within the receptacle at one end thereof, the stretcher head being secured to the other end of the tube, the tube has opposite ends, stretching the carpet radially away from the foot with the carpet stretcher extending radially from the foot in spaced apart positions extending the length of the expandable tube, repeating the stretching step at radially spaced apart positions, repeating the expanding and the stretching steps until the carpet has been stretched from the foot to the positions adjacent the periphery to the floor, and removing the foot from the floor.

A TENTH EXAMPLE, U.S. Pat. No. 5,938,182 to Goodrich et al. teaches a gauge including a housing mounted as a telescoping extension section in a power stretcher unit between the transfer tube and the baseplate. At one end of the housing is a connector for mating the housing to one point on the power stretcher, a chamber and a socket communicating with the chamber; at an opposite end of the housing is a movable piston which is slidably received in the socket at the first end, and a connector for mating the housing to a second point on the power stretcher. A sensing device is mounted in the chamber which senses the movement of the piston towards the chamber as occurs when a force is applied to stretch the carpet. Finally, a display, such as a gauge dial or digital display, can be connected to the sensing device for indicating to the operator of the power stretcher the force applied by the carpet stretcher to the carpet.

It is apparent that numerous innovations for carpet stretching tools have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a kneeless kicking tool for stretching a carpet that avoids the disadvantages of the prior art.

ANOTHER OBJECT of the present invention is to provide a kneeless kicking tool for stretching a carpet that is simple to use.

BRIEFLY STATED, STILL ANOTHER OBJECT of the present invention is to provide a kneeless kicking tool for stretching a carpet. A base rests on the carpet. A head is attached to the base and engages and stretches the carpet when an apparatus for propelling the head is activated. The apparatus includes a pair of rods that extend across the base and a ram. The ram has a body that slides on the pair of rods. When the ram is slid forwardly on the pair of rods and impacts upon the base, the head is caused to move forward and stretch the carpet. The ram further has a handle that extends from the body thereof and is grabbed by the hand of a user and used to slide the ram forwardly, and a weight that extends upwardly from the body thereof and which increases the impact of the ram on the base when the ram is slid forwardly on the pair of rods.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
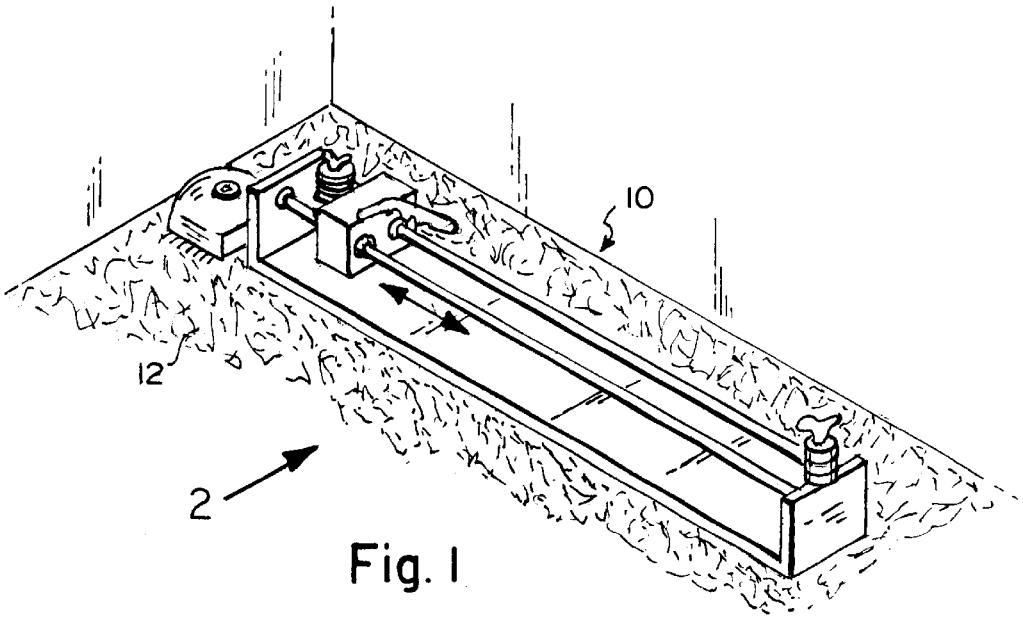
FIG. 1 is a diagrammatic perspective view of the invention in use.

10 kneeless kicking tool of present invention for stretching carpet 12
12 carpet
14 base for resting on carpet 12
16 head for engaging carpet 12 and stretches carpet 12 when apparatus 18 is activated
18 apparatus for propelling head 16
20 horizontal portion of base 14 for resting on carpet 12
22 pair of vertical portions of base 14
24 pair of ends of horizontal portion 20 of base 14
25 upper regions of pair of vertical portions 22 of base 14, respectively
26 weight of base 14 for holding base 14 on carpet 12
30 rearmost vertical portion 30 of pair of vertical portions 22 of base 14
32 at least one disk of weight 26 of base 14
34 wing screw of weight 26 of base 14
36 foremost vertical portion of pair of vertical portions 22 of base 14
38 pair of rods of apparatus 18
40 ram of apparatus 18
42 body of ram 40 of apparatus 18
44 bearings in body 42 of ram 40 of apparatus 18
46 upper region of body 42 of ram 40 of apparatus 18
47 ledge on upper region 46 of body 42 of ram 40 of apparatus 18
48 handle of ram 40 of apparatus 18 for grabbing by hand of user and used for sliding ram 40 of apparatus 18 forwardly on pair of rods 38 of apparatus 18
50 weight of ram 40 of apparatus 18
52 at least one disk of weight 50 of ram 40 of apparatus 18
54 wing screw of weight 50 of ram 40 of apparatus 18

DETAILED DESCRIPTION OF THE PREFERRED EMBODIMENT

Referring now to the figures, in which like numerals indicate like parts, and particularly to FIG. 1, the kneeless kicking tool of the present invention is shown generally at 10 for stretching a carpet 12.

Figure 2:
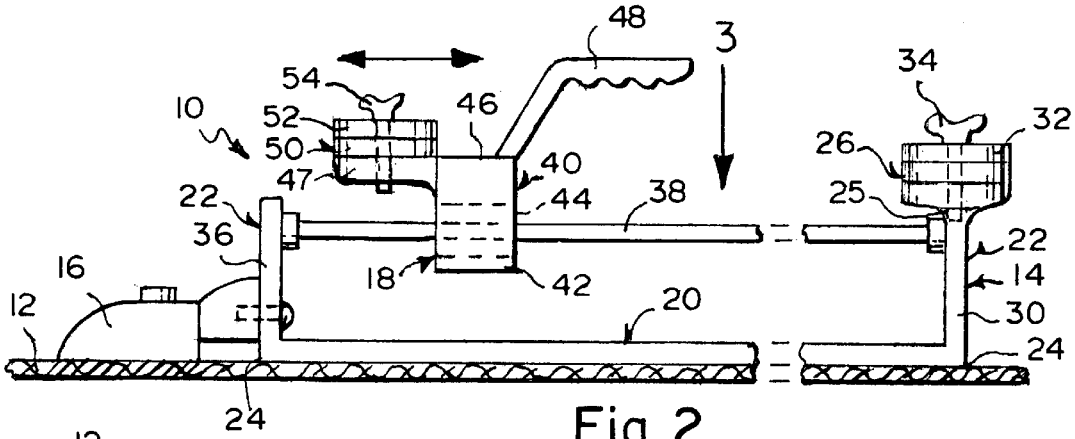
FIG. 2 is an enlarged diagrammatic side elevational view taken generally in the direction of ARROW 2 in FIG. 1.
Figure 3:
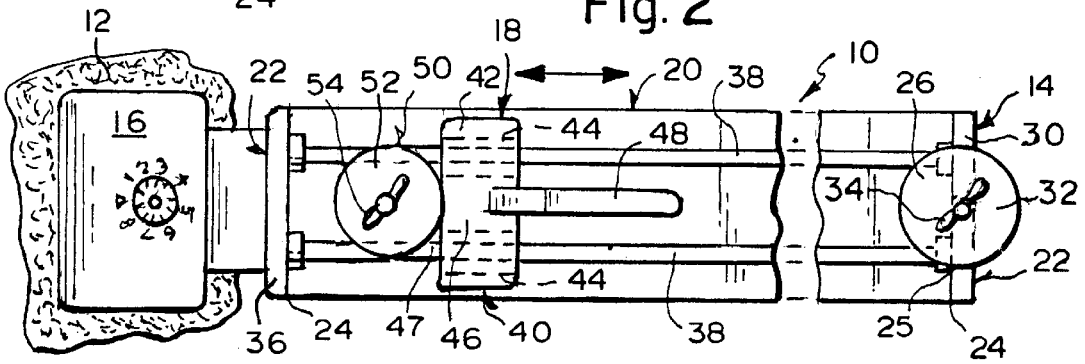
FIG. 3 is an enlarged diagrammatic top plan view taken generally in the direction of ARROW 3 in FIG. 2.

The configuration of the kneeless kicking tool 10 can best be seen in FIGS. 2 and 3, and as such, will be discussed with reference thereto.

The kneeless kicking tool 10 comprises a base 14, a head 16, and apparatus 18 for propelling the head 16. The base 14 is for resting on the carpet 12 and the head 16 is attached to the base 14 and is for engaging the carpet 12 and stretches the carpet 12 when the apparatus 18 is activated.

The base 14 comprises a horizontal portion 20 and a pair of vertical portions 22. The horizontal portion 20 of the base 14 is for resting on the carpet 12.

The horizontal portion 20 of the base 14 has a pair of ends 24. The pair of vertical portions 22 of the base 14 extend vertically upwardly from the pair of ends 24 of the horizontal portion 20 of the base 14, respectively, to upper regions 25 thereof, respectively.

The base 14 further comprises a weight 26. The weight 26 is for holding the base 14 on the carpet 12. The weight 26 is adjustably, centrally, and vertically attached to the upper region 25 of a rearmost vertical portion 30 of the pair of vertical portions 22 of the base 14.

The weight 26 comprises at least one disk 32 that is ring-shaped so as to allow a wing screw 34 to extend freely and vertically therethrough and engage in the upper region 25 of the rearmost vertical portion 30 of the pair of vertical portions 22 of the base 14.

The head 16 extends fixedly forwardly from a foremost vertical portion 36 of the pair of vertical portions 22 of the base 14.

The apparatus 18 comprises a pair of rods 38. The pair of rods 38 of the apparatus 18 are horizontally-oriented, parallel to each other, spaced horizontally apart form each other, and extend from the upper region 25 of the foremost vertical portion 36 of the pair of vertical portions 22 of the base 14 to the upper region 25 of the rearmost vertical portion 30 of the pair of vertical portions 22 of the base 14.

The apparatus 18 further comprises a ram 40. The ram 40 of the apparatus 18 slides on the pair of rods 38 thereof, and when slid forwardly on the pair of rods 38 thereof and impacts the foremost vertical portion 36 of the pair of vertical portions 22 of the base 14, the head 16 is caused to move forward and stretch the carpet 12.

The ram 40 of the apparatus 18 has a body 42. The body 42 of the ram 40 slides on the pair of rods 38 of the apparatus 18 via bearings 44 therein.

The body 42 of the ram 40 has an upper region 46 with a ledge 47 extending forwardly therefrom.

The ram 40 of the apparatus 18 further has a handle 48. The handle 48 of the ram 40 extends upwardly and rearwardly from the upper region 46 of the body 42 of the ram 40 and is for grabbing by the hand of a user and used for sliding the ram 40 of the apparatus 18 forwardly on the pair of rods 38 of the apparatus 18.

The ram 40 of the apparatus 18 further has a weight 50. The weight 50 of the ram 40 extends upwardly from the ledge 47 of the body 42 of the ram 40 and increases the impact of the ram 40 of the apparatus 18 on the foremost vertical portion 36 of the pair of vertical portions 22 of the base 14 when the ram 40 of the apparatus 18 is slid forwardly on the pair of rods 38 of the apparatus 18.

The weight 50 comprises at least one disk 52 that is ring-shaped so as to allow a wing screw 54 to extend freely and vertically therethrough and engage in the ledge 47 of the body 42 of the ram 40.

The at least one disk 32 of the base 20 is interchangeable with the at least one disk 52 of the apparatus 18.

It will be understood that each of the elements described above, or two or more together, may also find a useful application in other types of constructions differing from the types described above.

While the invention has been illustrated and described as embodied in a kneeless kicking tool for stretching a carpet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kneeless kicking tool for stretching a carpet, comprising:

a) a base;

b) a head; and c) means for propelling said head;

wherein said base is for resting on the carpet;

wherein said head is attached to said base;

wherein said head is for engaging the carpet; and wherein said head is for stretching the carpet when said means is activated, wherein said base comprises a horizontal portion;

wherein said base comprises a pair of vertical portions; and wherein said horizontal portion of said base is for resting on the carpet, wherein said horizontal portion of said base has a pair of ends; and wherein said pair of vertical, portions of said base extend vertically upwardly from said pair of ends of said horizontal portion of said base, respectively, to upper regions thereof, respectively, wherein said base comprises a weight;

wherein said weight of said base is for holding said base on the carpet;

wherein said weight of said base is adjustably attached to said upper region of a rearmost vertical portion of said pair of vertical portions of said base;

wherein said weight of said base is centrally attached to said upper region of said rearmost vertical portion of said pair of vertical portions of said base; and wherein said weight of said base is vertically attached to said upper region of said rearmost vertical portion of said pair of vertical portions of said base.

2. The tool as defined in claim 1, wherein said weight of said base comprises at least one disk; and wherein said at last one disk of said weight of said base is ring-shaped so as to allow a wing screw to extend freely and vertically therethrough and engage in said upper region of said rearmost vertical portion of said pair of vertical portions of said base.

3. The tool as defined in claim 1, wherein said head extends fixedly forwardly from a foremost vertical portion of said pair of vertical portions of said base.

4. The tool as defined in claim 3, wherein said means comprises a pair of rods;

wherein said pair of rods of said means are horizontally-oriented;

wherein said pair of rods of said means are parallel to each other;

wherein said pair of rods of said means are spaced horizontally apart from each other; and wherein said pair of rods of said means extend from said upper region of said foremost vertical portion of said pair of vertical portions of said base to said upper region of said rearmost vertical portion of said pair of vertical portions of said base.

5. The tool as defined in claim 4, wherein said means comprises a ram; and wherein said ram of said means slides on said pair of rods of said means, and when said ram of said means is slid forwardly on said pair of rods of said means and impacts upon said foremost vertical portion of said pair of vertical portions of said base, said head is caused to move forward and stretch the carpet.

6. The tool as defined in claims 5, wherein said ram of said means has a body; and wherein said body of said ram slides on said pair of rods of said means via bearings therein.

7. The tool as defined in claim 6, wherein said body of said ram has an upper region;

wherein said upper region of said body of said ram has a ledge; and wherein said ledge of said upper region of said body extends forwardly therefrom.

8. The tool as defined in claim 7, wherein said ram of said means has a handle;

wherein said handle of said ram extends upwardly from said upper region of said body of said ram;

wherein said handle of said ram extends rearwardly from said upper region of said body of said ram; and wherein said handle of said ram is for grabbing by the hand of a user and used for sliding said ram of said means forwardly on said pair of rods of said means.

9. The tool as defined in claims 7, wherein said ram of said means has a weight;

wherein said weight of said ram extends upwardly from said ledge of said body of said ram; and wherein said weight of said ram increases the impact of said ram of said means on said foremost vertical portion of said pair of vertical portions of said base when said ram of said means is slid forwardly on said pair of rods of said means.

10. The tool as defined in claim 9, wherein said weight of said ram comprises at least one disk; and wherein said at least one disk of said weight of said ram is ring-shaped so as to allow a wing screw to extend freely and vertically therethrough and engage in said ledge of said body of said ram.

11. The tool as defined in claim 10, wherein said at least one disk of said base is, interchangeable with said at least one disk of said means.

* * * * *